US005520795A

United States Patent [19]

Wong et al.

[11] Patent Number: 5,520,795

[45] Date of Patent: May 28, 1996

[54] METHOD FOR REDUCING THE AIR REACTIVITY OF CALCINED PETROLEUM COKE

[75] Inventors: Daisy K. Wong; Richard P. Ellingsen, both of Bellingham, Wash.; Bernie C. Vitchus, Villa Park, Calif.; Chris Bustamante, Downey, Calif.; James L. Mladenik, Irvine, Calif.

[73] Assignee: Atlantic Richfield Company, Los Angeles, Calif.

[21] Appl. No.: 12,117

[22] Filed: Feb. 1, 1993

Related U.S. Application Data

[63] Continuation of Ser. No. 750,668, Aug. 27, 1991, abandoned.

[51] Int. Cl.[6] ..... C10B 55/00; C10G 57/00; C10G 65/10

[52] U.S. Cl. ..... 208/46; 208/50; 208/53

[58] Field of Search ..... 208/46, 50, 53

[56] References Cited

U.S. PATENT DOCUMENTS

| | | | |
|---|---|---|---|
| H478 | 6/1988 | Blytas | 208/403 |
| 2,736,690 | 2/1956 | Mattox et al. | 208/53 |
| 3,917,564 | 11/1975 | Meyers | 208/131 |
| 4,130,475 | 12/1978 | Cameron et al. | 208/54 |
| 4,334,981 | 6/1982 | Holloway et al. | 208/131 |
| 4,341,751 | 7/1982 | Kiikka et al. | 423/265 |
| 4,547,284 | 10/1985 | Sze et al. | 208/50 |
| 4,666,585 | 5/1987 | Figgins et al. | 208/131 |
| 4,968,407 | 11/1990 | McGrath et al. | 208/131 |

*Primary Examiner*—E. Rollins Cross
*Assistant Examiner*—Patricia L. Hailey
*Attorney, Agent, or Firm*—F. Lindsey Scott

[57] ABSTRACT

The air reactivity of calcined petroleum coke is reduced by maintaining the amount of sodium in at least a portion of the water streams contacting the petroleum coke at a value below about 100 parts per million.

18 Claims, 1 Drawing Sheet

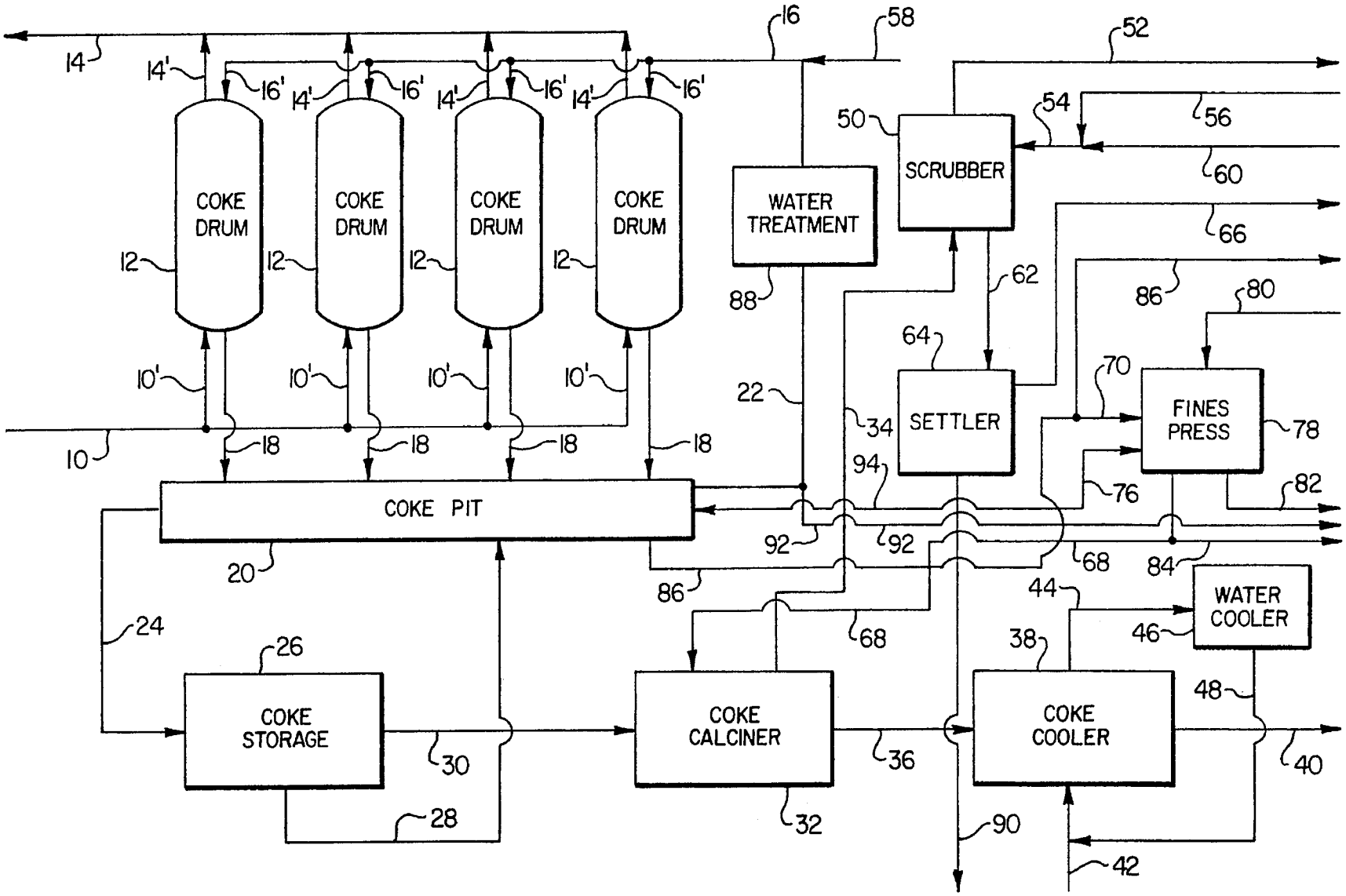
COKE DRUM
COKE DRUM
COKE DRUM
COKE DRUM
COKE PIT
COKE STORAGE
COKE CALCINER
COKE COOLER
WATER COOLER
FINES PRESS
SETTLER
SCRUBBER
WATER TREATMENT

METHOD FOR REDUCING THE AIR REACTIVITY OF CALCINED PETROLEUM COKE

This is a continuation, of application Ser. No. 07/750,668, filed Aug. 27, 1991, now abandoned.

BACKGROUND OF THE INVENTION

1. Field of the Invention

This invention relates to the reduction of the air reactivity of calcined petroleum coke.

2. Background

Petroleum coke is generally produced commercially by charging a heavy petroleum residuum stream to a coking drum at an elevated temperature, typically from about 800° F. to about 900° F., until the drum is filled and the heavy petroleum residuum has been converted to petroleum coke. As the coke forms in the coking drum, the heavy petroleum residuum decomposes into petroleum coke which is recovered from the coking drum by the use of high-impact-producing water jets which are used to drill the petroleum coke from the coke drum. The coke typically falls into a coke pit from which it is recovered and passed to coke storage, and thereafter to coke calcining to produce the calcined petroleum coke. In this process water streams contact the petroleum coke in the form of the high-pressure water used to drill the petroleum coke from the coking drum, in the coke pit where the petroleum coke is collected as well as in coke coolers which typically comprise rotary coolers which use a water stream to cool the coke from typical calcining temperatures of about 2000° F. to about 100° F. or spray coolers. Frequently, an aqueous sodium hydroxide stream is used to scrub the off-gases from the coke calciner to produce a clean off-gas stream. Such processes are considered to be well-known to the art and representative processes are disclosed in U.S. Pat. No. 3,917,564, issued Nov. 4, 1975 to Meyers and assigned to Mobil Oil Corporation; U.S. Pat. No. 4,334,981, issued Jun. 15, 1982 to Holloway et al and assigned to Atlantic Richfield Company; U.S. Pat. No. 4,547,284, issued Oct. 15, 1985 to Sze et al and assigned to Lummus Crest Inc.; U.S. Pat. No. 4,666,585, issued May 19, 1987 to Figgins et al and assigned to Atlantic Richfield Company; and U.S. Pat. No. 4,968,407, issued Nov. 6, 1990 to McGrath et al and assigned to Foster Wheeler USA Corporation, all of which are hereby incorporated in their entirety by reference.

In such processes, the resulting calcined petroleum coke frequently has an air reactivity from about 0.2 to about 0.3 weight percent per minute. Air reactivity is generally determined by a test comprising heating the calcined petroleum coke to an elevated temperature such as, for instance, about 600° F. and passing air over the heated sample of calcined petroleum coke. The air reactivity represents the weight percent loss per minute as a result of reaction with air at the elevated temperatures.

Many users of calcined petroleum coke wish the air reactivity to be from about 0.1 to about 0.15 weight percent per minute or less.

As a result, a continuing effort has been directed to the development of methods for the production of calcined petroleum coke which result in the production of calcined petroleum coke having a reduced air reactivity.

SUMMARY OF THE INVENTION

It has now been found that the air reactivity of calcined petroleum coke is reduced by maintaining the amount of sodium in at least a portion of the water streams contacting the petroleum coke at a value below about 100 parts per million.

DESCRIPTION OF THE DRAWINGS

The FIGURE is a schematic diagram of an embodiment of a process embodying the present invention.

DESCRIPTION OF PREFERRED EMBODIMENTS

In the discussion of the FIGURE, reference will be made to lines used for the conveyance of materials without regard to whether the lines are pipes, conveyors, other solids handling devices or the like. Similarly, no pumps, compressors or the like have been shown to accomplish the flows discussed.

In the FIGURE a heavy hydrocarbon feed stream suitable for use as a petroleum coking feedstock is charged through a line 10 and one of a plurality of lines 10' to a coke drum 12. A plurality of coke drums 12 have been shown since in such processes feed stock is charged to a coke drum until the coke drum is filled and thereafter switched to a second or subsequent coke drum while the coke is drilled from the first drum. Subsequently the first drum is returned to service and the process is repeated. During the coking process lighter hydrocarbons are produced as the solid petroleum coke is formed. The lighter hydrocarbons are recovered from coke drum 12 through one of a plurality of lines 14' and a line 14 and passed to further processing. As well known to those skilled in the art, a substantial portion of the heavy hydrocarbon feed to the coking drum is recovered from the coking drum as more valuable light hydrocarbons. After the coke has formed in a coke drum 12, a high-pressure water jet (not shown) is used to drill the petroleum coke from the coke drum. The water charged to the high-pressure water jet is supplied through a line 16 and one of a plurality of lines 16'. As the coke is cut or drilled from a coke drum 12, it falls from the coke drum through a line 18 into a coke pit 20 from which it is recovered and passed through a line 24 to coke storage 26. In coke storage 26, water typically drains from the coke and is returned via a line 28 to coke pit 20. The petroleum coke from coke storage 26, commonly referred to as green coke, is passed through a line 30 to a coke calciner 32, which may be a rotary kiln or a rotary hearth calciner, where it is calcined at an elevated temperature frequently up to about 2000° F. to produce calcined petroleum coke. The calcined petroleum coke is passed through a line 36 to a coke cooler 38 which is typically a rotary cooler wherein water is used as a cooling medium to reduce the temperature of the calcined petroleum coke from about 2000° F. to about 100° F., as shown, or a water spray cooling zone where a water spray is used to accomplish the desired cooling.

Rotary coolers are subject to great thermal stress and frequently leaks, with the result that the water used for cooling leaks into contact with the calcined petroleum coke directly and leaks from the exterior of the coke cooler. This water may be recovered and passed to coke pit 20, to waste or the like. Typically the water used in coke cooler 38 is charged to coke cooler 38 through a line 42 and may consist of fresh water or recycled water from a line 48. The heated water discharged from coke cooler 38 is recovered through a line 44, passed to a water cooler 46, which may be a fin-fan cooler or the like, where it is cooled and recycled through line 48 back to line 42 and coke cooler 38. Make-up water, as indicated, may be supplied through line 42. The resulting cooled calcined petroleum coke is recovered through a line 40 and passed to product. Alternatively, water spray coolers (not shown) may be used. Such systems also involve water evaporation from the hot calcined coke and may involve recycle of portions of the spray water or discharge of portions of the used spray water.

The hot gases produced in coke calciner 32 are passed through a line 34 to a scrubber 50 where they are contacted with an aqueous scrubbing solution, which frequently is an aqueous sodium hydroxide solution, for the recovery of coke fines, acidic gases and the like to produce a clean exhaust gas stream which is discharged through a line 52. The water used to produce the aqueous scrubbing solution in the FIGURE is supplied via a line 56. The chemicals required to produce the aqueous scrubbing solution are supplied through a line 60 with the resulting aqueous scrubbing solution being charged to scrubber 50 through a line 54. The resulting aqueous slurry of recovered acidic gas compounds, coke fines and the like is recovered through a line 62 and passed to a settler 64 where it is separated into an aqueous overhead stream which is passed via a line 66 to waste treatment (not shown) and a bottoms stream comprising primarily coke fines which may be returned to coke pit 20 via a line 90 and a line 94 but is preferably passed to waste treatment via line 90. These coke fines are produced in the drilling process by which the petroleum coke is removed from coke drum 12 and some coke fines are usually discharged from coke calciner 32 with the exhaust gases.

The water required in line 16 is taken from coke pit 20 via a line 22 and treated in a water treatment section 88 by filtration and the like as necessary to produce water suitable for use in the water jets used to drill petroleum coke from coke drum 12.

In such processes the sodium contained in coke pit 20 results at least in part from the use of the sodium-containing scrubbing solution in scrubber 50. Since coke pit 20 is used as a supply of water for the drilling water, the coke is subjected to contact with a relatively high-sodium-containing liquid as it is drilled from coke drum 12. This water typically contains from about 200 to about 300 parts per million (ppm) sodium. The coke is then discharged into coke pit 20 where it is further contacted with water which also contains relatively high quantities of sodium. Similarly, the water used in coke cooler 38 tends to become relatively high in sodium content since it is recycled and since it is in contact with the calcined petroleum coke at elevated temperatures in a final process step during which it may be evaporated from the calcined petroleum coke. Sodium contents as high as 1000 to 3000 ppm have been measured in the cooling water used in coke cooler 38 when sodium containing corrosion inhibitors are used in the cooling water.

It has now been found that reducing the amount of sodium in water streams contacting the green coke and the calcined petroleum coke greatly reduces the air reactivity of the calcined petroleum coke. The air reactivity of the calcined petroleum coke can be reduced by reducing the sodium content of at least a portion of the aqueous streams contacting the coke during the production process to less than about 100 ppm. Desirably, the sodium in the water used to drill the petroleum coke from coke drum 12 is maintained at a sodium content less than about 100 parts per million, preferably less than about 60 parts per million and even more preferably below about 20 parts per million. This reduction can be accomplished by increasing the amount of make-up water and removing some of the water which contains sodium via a line 92. In many instances it will be desirable to recycle this stream, either because of its unsuitability for treatment in the waste treatment facilities or because of a need to conserve water. Other approaches could also be used such as ion exchange treatment of the water in treating section 88 or the like.

A further reduction is realized by controlling the amount of sodium in the cooling water used in coke cooler 38. This reduction can be accomplished by increasing the amount of make-up water and removing some of the water which has been in contact with the coke in coke cooler 38, by use of de-ionization equipment, by use of non-cationic metal ion (especially sodium) containing corrosion inhibitors such as organic filming amines for corrosion control and the like. Desirably, the sodium content of this stream is maintained at a value less than about 100 ppm and preferably below about 10 ppm. Similarly, the sodium content of the spray water used for spray cooling calcined coke should be controlled to like levels.

The means for removing the sodium from these streams can vary substantially depending upon the particular arrangement of the water flow for a particular petroleum coking unit. Many methods for removing metallic ions from aqueous streams are known to those skilled in the art and it is anticipated that many of such techniques will be found suitable to remove the sodium or other undesirable metals from the aqueous streams discussed above in various ways known to those skilled in the art.

A possible source of sodium on the calcined petroleum coke is recycled fines from settler 64. Fines, if recycled to coke calciner 32, result in an increased air reactivity in the calcined petroleum coke even though many of the fines are consumed in or entrained from coke calciner 32. A similar result occurs when petroleum coke fines from settler 64 are recycled to either coke pit 20 or coke storage 26. Addition of fines from coke pit 20 to coke in coke calciner 32 also results in an increase in the air reactivity of the calcined petroleum coke. If these fines are to be recycled, or when the fines are to be used as a fuel, it is desirable to treat the fines by passing them through line 90 and a line 76 to a fines press 78. In fines press 78, the coke fines are washed with fresh water supplied through a line 80 and discharged to waste treatment through a line 82 and at least partially de-watered to remove at least seventy percent (70%) and preferably at least ninety percent (90%) of the sodium from the coke fines prior to passing them to use as a fuel via a line 84 or recycling them back to coke calciner 28 via line 84 and a line 68. Optionally, the washed fines could be recycled back to coke storage 26. The washing of the petroleum coke fines represents a major reduction in the sodium on the fines.

When the sodium content of the water streams contacting the petroleum coke is reduced to a value less than about 100 parts per million and desirably to lower levels as discussed above, it has been found that the air reactivity of the petroleum coke is reduced from about 0.2 to about 0.3 weight percent per minute to a value from about 0.1 to about 0.15 weight percent per minute or less. It is surprising and unexpected that such an improvement could be accomplished by removal of the sodium from the aqueous streams in view of the nature of the petroleum coke product which is generally immiscible with water and is not considered to absorb substantial quantities of water.

Control of the amount of sodium in lines 16 and 94 and in any fines passed to coke pit 20 or coke storage 26 effectively controls the amount of sodium in the water in coke pit 20. Coke fines in coke pit 20 may be passed from coke pit 20 to disposal via a line 86 or, alternatively, to washing in fines press 78 via line 86 and a line 70 if desired.

It is also noted that other mono- and di-valent metallic cations, such as potassium, barium, calcium and magnesium, can have a similar effect to sodium and it is desirable that the amount of such other metallic ions also be kept to relatively low levels, i.e. desirably less than about 100 parts per million in the aqueous streams. The effect of the other metals, however, does not appear to be as significant as sodium.

The desired sodium levels are readily maintained at levels as discussed above by periodically determining the amount of sodium in each aqueous stream of interest and adjusting the sodium level to the desired level.

The desirable air reactivity results accomplished are also noted in anodes formed from the calcined petroleum coke. While frequently the air reactivity is of less interest to the users of anodes formed from the calcined petroleum coke, it is of interest in some instances.

Having thus described the invention by reference to certain of its preferred embodiments, it is pointed out that the embodiments described are illustrative rather than limiting in nature and that many variations and modifications are possible within the scope of the present invention. It is anticipated that many such variations and modifications may be considered obvious and desirable by those skilled in the art based upon a review of the foregoing Description of Preferred Embodiments.

Having thus described the invention, we claim:

1. A method for reducing the air reactivity of calcined petroleum coke wherein said calcined petroleum coke is produced by a process comprising: charging a heavy petroleum residuum feed stream to a coking drum at coking conditions of temperature and pressure to produce petroleum coke in said coking drum, removing said petroleum coke from said coking drum with a high pressure water jet, calcining said petroleum coke in a calcining zone to produce said calcined petroleum coke and cooling said calcined petroleum coke in a cooler by heat exchange with a cooling water stream; said method comprising periodically determining the amount of sodium in each of the water streams contacting said petroleum coke and reducing the amount of sodium in each water stream to a value below about 100 ppm.

2. The method of claim 1 wherein the amount of sodium in drilling water used in said water jet is reduced to a value less than about 60 ppm.

3. The method of claim 2 wherein said amount is reduced to a value less than about 20 ppm.

4. The method of claim 1 wherein the amount of sodium in said cooling water is reduced to a value less than about 100 ppm.

5. The method of claim 4 wherein the amount of sodium in said cooling water is periodically determined and adjusted to a value below about 100 ppm.

6. The method of claim 4 wherein said value is less than about 10 ppm.

7. The method of claim 1 wherein coke fines returned to said calcining zone are washed with a water stream prior to return to said calcining zone.

8. The method of claim 7 wherein said washing is sufficient to remove at least 70 percent of the sodium from said coke fines prior to return to said calcining zone.

9. The method of claim 8 wherein at least 90 percent of said sodium is removed.

10. The method of claim 1 wherein said heavy petroleum residuum feed stream is charged to said coking drum at a temperature from about 800° to about 900° F. and wherein said calcining is at a temperature up to about 2000° F.

11. The method of claim 1 wherein said calcined coke is cooled to a temperature of about 100° F.

12. A method for reducing the air reactivity of calcined petroleum coke wherein said calcined petroleum coke is produced by a process comprising: charging a heavy petroleum residuum feed stream to a coking drum at coking conditions of temperature and pressure to produce petroleum coke in said coking drum, removing said petroleum coke from said coking drum with a high pressure water jet, calcining said petroleum coke in a calcining zone to produce said calcined petroleum coke and cooling said calcined petroleum coke by spraying water onto said calcined petroleum coke; said method comprising periodically determining the amount of sodium in each of the water streams contacting said petroleum coke and reducing the sodium content of water streams to a value below about 100 ppm.

13. The method of claim 12 wherein the amount of sodium in drilling water used in said water jet is reduced to a value less than about 60 ppm.

14. The method of claim 13 wherein the amount of sodium in said drilling water is periodically determined and adjusted to a value less than about 160 ppm.

15. The method of claim 13 wherein said amount is maintained at a value less than about 20 ppm.

16. The method of claim 12 wherein the amount of sodium in said water sprayed onto said calcined petroleum coke is periodically determined and adjusted to a value below about 100 ppm.

17. The method of claim 12 wherein said value is less than about 10 ppm.

18. The method of claim 12 wherein said heavy petroleum residuum feed stream is charged to said coking drum at a temperature from about 800° to about 900° F. and wherein said calcining is at a temperature up to about 2000° F.

* * * * *